United States Patent [19]

Karr

[11] 4,030,446

[45] June 21, 1977

[54] DIRECTED FLOW IONIZATION CHAMBER IN ELECTROSTATIC COATING

[75] Inventor: Allan V. Karr, Stratford, Conn.

[73] Assignee: Electrostatic Equipment Corporation, New Haven, Conn.

[22] Filed: Apr. 30, 1976

[21] Appl. No.: 682,183

[52] U.S. Cl. ..... 118/654
[51] Int. Cl.[2] ..... B05B 5/02
[58] Field of Search ..... 118/629–635; 118/DIG. 5, 654; 427/21, 27, 28, 29, 32, 33, 38–41; 101/DIG. 13; 355/3 DD; 313/231

[56] References Cited

UNITED STATES PATENTS

| | | | |
|---|---|---|---|
| 3,537,426 | 11/1970 | Spiller et al. | 118/629 |
| 3,817,211 | 6/1974 | Brown et al. | 118/630 |
| 3,916,826 | 11/1975 | Knudsen | 118/629 |

*Primary Examiner*—Morris Kaplan

[57] ABSTRACT

Electrostatic fluidized bed coating apparatus utilizes an electrode which provides a multiplicity of charge-concentrating portions, into contact with which an air stream is directed in a flow path conforming substantially to the form of and to effect ionization thereof. The ionized air is then used for simultaneous fluidization and charging of a particulate coating material.

6 Claims, 3 Drawing Figures

DIRECTED FLOW IONIZATION CHAMBER IN ELECTROSTATIC COATING

BACKGROUND OF THE INVENTION

Electrostatic fluidized bed coating is now a conventional and widely-used technique for depositing particulate materials upon a great diversity of workpieces. In Knudsen U.S. Pat. No. 3,916,826, apparatus is described in which ionized air is employed for the simultaneous charging and fluidization of the particulate coating material employed therein, affording the advantage of safety, combined with outstanding effectiveness. An important prerequisite to satisfactory operation of such apparatus is the efficient ionization of the air so employed. While the various high-efficiency charging means described by Knudsen are entirely effective and satisfactory, even more efficient ionization of the air would produce concomitantly results, with less power consumption, and hence with greater safety and at lower cost. Moreover, alternative electrode configurations and air flow patterns may be desired for some purposes.

Accordingly, it is an object of the present invention to provide novel electrostatic fluidized bed coating apparatus wherein air used to fluidize and charge the coating material is ionized in a highly efficient and effective manner.

It is also an object of the invention to provide such apparatus wherein operation occurs at reduced levels of power consumption and, therefore, with improved safety and lower cost.

Another object is to provide apparatus affording the foregoing advantages which is, at the same time, relatively simple and inexpensive to manufacture.

SUMMARY OF THE DISCLOSURE

It has now been found that certain of the foregoing and related objects of the present invention are readily attained in electrostatic fluidized bed coating apparatus comprising, in combination: a housing having a porous support member mounted therein to define, within the housing, a fluidization chamber thereabove and a plenum therebelow; electrode means having multiple charge-concentrating portions thereon; and means for direction air preferentially into contact with the charge-concentrating portions of the electrode means. The electrode means and the air-directing means are so disposed as to cause the air to pass through the plenum in a flow path from the air-directing means into contact with the electrode means, whereby the air is ionized, and thereafter upwardly through the support member into the coating chamber. The thus ionized air may be used to charge and fluidize a particulate coating material supported, in the coating chamber, on the support member of the housing.

In preferred embodiments of the invention, the electrode means comprising a multiplicity of fine wires, and means for supporting the wires at one end thereof, with their free ends disposed in the air-flow path and providing the charge-concentrating portions thereof. The supporting means may be provided by a shaft from which the wires extend radially outwardly at a plurality of locations along the length thereof. Most desirably , the wires will be of substantially equal length, so that the free ends thereof are disposed on an imaginary cylindrical surface which is coaxially aligned with the shaft. The shaft, in turn, is desirably mounted upon a generally horizontal base plate with its axis normal thereto. The base plate will have a multiplicity of holes therethrough, which are disposed in a circular pattern about the base of the shaft, with the diameter of the circular pattern being substantially the same as that of the imaginary cylindrical surface defined by the free ends of the wires. Such apparatus will also include a chamber under the base plate into which air may be introduced, and from which the holes in the base plate provide substantially the only outlet. As a result, air introduced under pressure into the chamber will flow from the holes in discreet streams or jets toward the free ends of the wires. Generally, the base plate of such apparatus will define the bottom of the plenum.

Certain objects of the invention are attained in an apparatus for coating a workpiece, wherein a bed of particulate material capable of acquiring an electrostatic charge is disposed upon a porous support plate. Electrode means having multiple charge-concentrating portions thereon is charged to a high voltage, and at least one stream of air is directed preferentially into contact with the charge-concentrating portions of the charged electrode means, to thereby ionize the air. Thereafter, the stream of ionized air is passed upwardly through the support plate to fluidize the bed of particulate material, and simultaneously electrostatically charge the particles thereof. Disposing a workpiece proximate to the bed of charged particles, while maintaining it at an effectively opposite electrical potential thereto, will cause attraction and adherence of the particles to the workpiece, and thereby produce a coating thereon. Preferably, a multiplicity of streams will be passed upwardly into contact with the charge-concentrating portions of the charged electrode means.

DETAILED DESCRIPTION OF THE ILLUSTRATED EMBODIMENT

Figure 1:
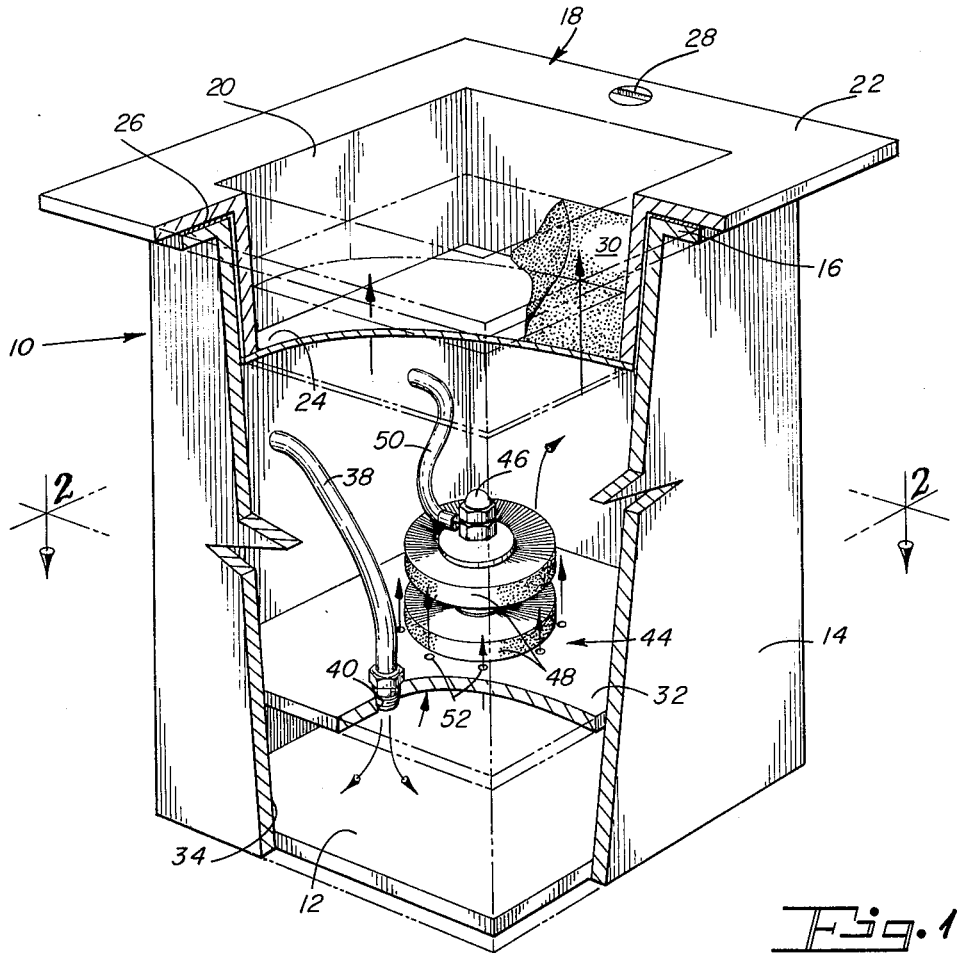
FIG. 1 is a perspective view of electrostatic fluidized bed apparatus embodying the present invention, with portions broken away to expose internal structure thereof.
Figure 2:
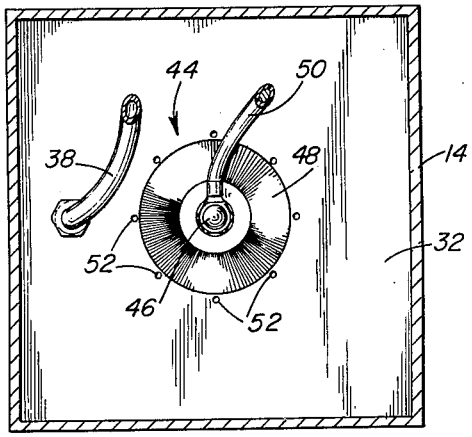
FIG. 2 is a sectional view of the apparatus of FIG. 1, taken along line 2-2 thereof.
Figure 3:
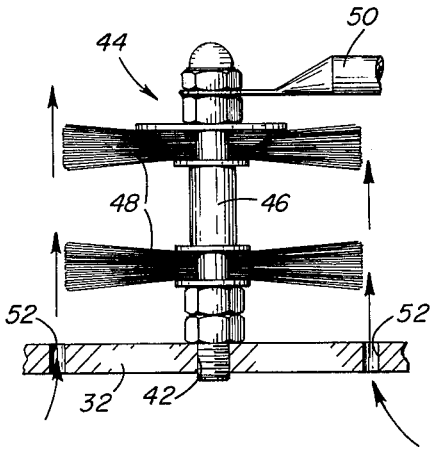
FIG. 3 is an elevational view of the electrode assembly used in the apparatus of FIGS. 1 and 2, drawn to an enlarged scale and showing portions of the associated porous plate and electrical cable.

Turning now in detail to the appended drawing, therein illustrated is electrostatic fluidized bed coating apparatus embodying the invention hereof, and including an open-top housing, generally designated by the numeral 10, terminating in an outwardly-extending upper peripheral flange 16. A rectangular tray, generally designated by the numeral 18, is removably seated within the open top of the housing and comprises a sidewall 20 having a flange 22 extending outwardly about its upper periphery, and a porous bottom wall or floor 24 secured to the lower edge thereof. As can be seen, the tray 18 is dimensioned and configured to conform closely to the opening of the housing 10. A suitable gasket 26 is interposed between the flanges 16,22 to afford a gas-tight seal therebetween, and the tray 18 is secured to the housing 10 by suitable fasteners 28 extending through the flanges 16,22; particulate coating material 30 is contained within the tray 18.

A rectangular base plate 32 spans the lower portion of the housing 10, with its edges sealing joined to the wall 14 to define an underlying air chamber 34 and a plenum 36 thereabove. A hose or tube 38, connected to a source of pressurized air (not shown), passes through the sidewall 14 and is secured with an appropriate fixture in an opening 40 of the base plate 32, thus enabling pressurization of the air chamber 34. Secured in a centrally-disposed second opening 42 of the plate 32 is an electrode member, generally designated by the numeral 44 and consisting of an upstanding post assembly 46 (comprised of appropriate nuts, washers, spacers and a core) and two axially spaced, generally circular clusters 48 of wire bristles. The bristles of the clusters 48 are supported at one end by the post 46, and radiate outwardly thereform with their free ends disposed approximately on an imaginary cylindrical surface; and electrical cable 50, from a high voltage source (not shown), passes through the sidewall 14 and is affixed by appropriate means to the top of the post 46. The plate 32 has, in addition, eight relatively small holes 52 extending therethrough and arranged in a ring concentrically about the post 46, the diameter of the ring being about the same as that of the bristle clusters 48. As will be evident, the holes 52 afford substantially the only outlet for air supplied to the underlying chamber 34.

In operation of the apparatus illustrated, voltage is applied to the electrode member 44 through the cable 50, and air under pressure is passed through the hose 38 into the air chamber 34. The air passes, as discreet streams, upwardly through the holes 52 into contact with the free end portions of the bristles of the clusters 48, whereat it becomes ionized. Finally, the thus ionized air flows through the porous bottom wall 24 of the tray 18 and into the mass of powder 30 supported thereupon. The air not only fluidizes the powder, in a conventional manner, but also electrostatically charges the particles thereof, as described more fully in the above-identified Knudsen patent.

As is well known, on a conductor of variable curvature, charge density increases with an increase in curvature; this is because a conductor has the same potential at all points on its surface. Consequently, if an electrode has sharp or pointed portions, the electrical charge will tend to be most concentrated at such portions, providing regions of intense electrification from which discharge will occur most readily.

Accordingly, it is believed that, by directing the streams of air from the chamber 38 into preferential contact with the free, pointed end portions of the wires, ionization of the air is effected most efficiently. It will be appreciated that the location of the holes 52 in the plate 32 provides a simple and effective manner of so directing the air.

As will be appreciated by those skilled in the art, the configurations of the unit and of the electrode means employed may vary widely, and still embody the concepts of the invention and achieve the objects and benefits thereof. The important features entail the use of electrode means on which charge-concentrating portions are present, and means for directing the air, ultimately used for fluidization and charging of the particulate coating material, preferentially into contact with such portions of the electrode means. Thus, for example, rather than a brush-type electrode mounted vertically within the plenum of the coating unit, a grid of pointed elements, having their ends disposed in a stream of air conveyed to the plenum, could be used. While, moreover, a single electrode member is used in the illustrated embodiment, it will, in some instances, be advantageous to employ a plurality of like members, in which case a conductive base plate may be used to electrically interconnect them. In addition, rather than using the type of support plate shown, a series of nozzles could be substituted to effect air contact with the charge-concentrating portions of the electrode. Finally, it should be appreciated that, although the invention has been described in terms of ionized air used for fluidization and charging, other ionizable gases could be employed, if so desired. Suitable materials of construction will be apparent to those skilled in the art, and need not be discussed extensively. The use of synthetic resinous dielectric materials for the housing and associated parts and fittings will generally provide an optimum combination of safety, performance, and facility and economy of fabrication. The porous support member (which phrase as used herein as a generic expression for the so-called porous plates, membranes, and the like, that are conventionally used to support the fluidized bed) may be made of any suitable material, including the ceramics that have been widely used in the past; however, porous plastics (such as the polyolefins) are preferred.

Virtually any particulate or finely divided material that is capable of receiving and retaining (at least for a short time) an electrostatic charge may be employed in the practice of the invention. Such materials are well known, and constitute a rather extensive list; by way of illustration, exemplary coating materials include inorganics, such as the phosphors, talc, chalk; organic resins and elastomers, such as the polyolefins (e.g. polyethylene, polypropylene, EPR, EPT, other interpolymers and copolymers, ionamers), the ethylenically unsaturated hydrocarbon polymers and derivatives (e.g. polyvinyl chloride, polyvinylidene chloride, polystyrene, polybutadiene, ABS), acrylic polymers, polyacetals, epoxy resins, cellulosics, polyamides; etc. In most cases, the specific coating material employed will dictate what, if any, treatment the workpiece will be subjected to (before or after deposition) in order to produce the sort of coating that is ultimately desired. Conventional treatments include heating (to enhance initial adherence of the coating material, to cure a B-stage resin or prepolymer, to fuse the particles of the deposit into a unified coating), adhesive coating, ultrasonic wave or actinic radiation exposure, etc., and the method of the invention is adapted to accommodate treatments of such nature.

The variety of workpieces to which the principles of the invention are applicable is virtually endless, and includes any object that is capable of exhibiting an electrical potential that is effectively opposite to the charged particles (which is normally achieved by grounding the object and charging the particles negatively, but which may be achieved otherwise, such as with the particles and object having the same electrical sign, relative to ground, of different valves). It will be understood that the apparatus shown will frequently be employed in a system that includes other equipment. For example, since it is usually desirable to recover undeposited coating material and to prevent contamination of the surrounding area therewith, vacuum recovery apparatus may be associated with the fluidized bed unit. Similarly, the systems may include the ovens or the like that are necessary to perform the pre- and post-coating treatments hereinbefore alluded to, and gas and power control mechanisms, consoles, etc. will also be furnished in an integrated system.

Thus, it can be seen that the present invention provides novel electrostatic fluidized bed coating apparatus, wherein air used to fluidize and charge the coating material is ionized in a highly efficient and effective manner. The apparatus is capable of operation at reduced levels of power consumption, and therefore with improved safety and at lower cost. Moreover, the apparatus may be relatively simple and inexpensive to manufacture.

Having thus described the invention, what is claimed is:

1. Electrostatic fluidized bed coating apparatus comprising, in combination: a housing having a porous support member mounted therein to define within said housing a fluidization chamber thereabove in a plenum therebelow; electrode means having multiple charge-concentrating portions thereon; and means for directing air in a flow path conforming substantially to the form of and into contact with said charge-concentrating portions of said electrode means, to thereby ionize the air, said electrode means and said air-directing means being so disposed as to pass air through said plenum in a flow path from said directing means, into contact with said electrode means, and upwardly through said support member and into said coating chamber, whereby the resultant ionized air may be used to charge and fluidize a particulate coating material supported in said coating chamber on said support member.

2. The apparatus of claim 1 wherein said electrode means comprises a multiplicity of fine wires, and means for supporting said wires at one end with their free ends disposed in said air flow path, said free ends providing said charge-concentrating portions of said electrode means.

3. The apparatus of claim 2 wherein said supporting means is a shaft which said wires extend radially outwardly at a plurality of locations along the length thereof.

4. The apparatus of claim 3 wherein said wires are of substantially equal length, so that said free ends thereof are disposed on an imaginary cylindrical surface which is coaxially aligned with said shaft.

5. The apparatus of claim 4 wherein said shaft is mounted upon a generally horizontal base plate with its axis normal thereto, said base plate having a multiplicity of holes therethrough disposed in a circular pattern about the base of said shaft, with the diameter of said circular pattern being substantially the same as that of said imaginary cylindrical surface, and wherein said apparatus includes a chamber under said base plate into which air may be introduced, said holes providing substantially the only outlet from said chamber, so that air introduced under pressure into said chamber flows from said holes in discreet streams toward said free ends of said wires.

6. The apparatus of claim 5 wherein said base plate defines the bottom of said plenum.

* * * * *

UNITED STATES PATENT AND TRADEMARK OFFICE

CERTIFICATE OF CORRECTION

PATENT NO. : 4,030,446
DATED : June 21, 1977
INVENTOR(S) : ALLAN V. KARR

It is certified that error appears in the above-identified patent and that said Letters Patent are hereby corrected as shown below:

In the ABSTRACT, line 5, insert --said portions-- after "form of"

Column 1, line 19, insert --better-- after "concomitantly"

Claim 3, line 2 (Column 6, line 10) insert --from-- after "shaft"

Signed and Sealed this

Sixth Day of December 19

[SEAL]

Attest:

RUTH C. MASON
Attesting Officer

LUTRELLE F. PARKER
Acting Commissioner of Patents and Tradema